US005505041A

United States Patent [19]

Harlan

[11] Patent Number: 5,505,041

[45] Date of Patent: Apr. 9, 1996

[54] METHOD FOR PRODUCING DEODORANT/ANTIPERSPIRANT STILL REFILL

[76] Inventor: Robert L. Harlan, 1422 Three Oaks Ave., Maple Plain, Minn. 55359

[21] Appl. No.: 423,835

[22] Filed: Apr. 18, 1995

Related U.S. Application Data

[63] Continuation-in-part of Ser. No. 86,679, Jul. 1, 1993, abandoned.

[51] Int. Cl.[6] ..... B65B 5/04

[52] U.S. Cl. ..... 53/473; 53/122; 206/385

[58] Field of Search ..... 53/122, 473; 206/385; 401/68, 75, 82; 425/DIG. 32

[56] References Cited

U.S. PATENT DOCUMENTS

| | | | |
|---|---|---|---|
| 2,629,489 | 2/1953 | Shelly | 206/385 |
| 2,678,128 | 5/1954 | Sherman | 206/385 |
| 2,753,991 | 7/1956 | Sherman | 425/DIG. 32 X |
| 2,767,834 | 10/1956 | Sherman | 425/DIG. 32 X |
| 3,214,012 | 10/1965 | Mack | 206/385 |
| 3,393,036 | 7/1968 | Fuglsang-Madsen | 206/385 X |
| 3,429,643 | 2/1969 | Seaver | 401/75 |
| 3,912,403 | 10/1975 | Gjerloff | 401/82 X |
| 4,884,912 | 12/1989 | Gueret | 401/68 X |
| 4,950,094 | 8/1990 | Yorks | 401/75 |
| 5,255,990 | 10/1993 | Dornbusch et al. | 401/68 |

FOREIGN PATENT DOCUMENTS

| | | | |
|---|---|---|---|
| 4120969 | 5/1992 | Germany | 206/385 |

*Primary Examiner*—John Sipos
*Assistant Examiner*—Daniel Moon

[57] ABSTRACT

A deodorant/antiperspirant solid stick form product, formed and extruded from a mold having a cavity in the shape of the desired stick and within said cavity a threaded shaft axially oriented therein and rotably mounted at the bottom side through an aperture. An elevator platform is threadably mounted to the base of the threaded shaft. Chemical product is then poured into the mold in its liquid or molten state. Upon cooling, the product solidifies and takes on the shape of the cavity of the mold. Reverse rotation of the threaded shaft advances the elevator platform and its now attached stick out of the mold and into a thin walled recyclable refill package. The body of the package is in the shape of the stick, one end is closed and has a sealed vent aperture, the other end is open, broadened and sealed. An empty dispenser (now with its used up stick elevator platform removed and discarded) is coupled to the refill containers open broadened end in a close fitting engagement. The refill containers seal is removed from the vent aperture releasing back pressure from the refill stick and the hand wheel, located on the dispenser, is rotated which in turn rotates the threaded shaft located in the dispenser which threadably engages with the refill stick attached elevator platform and draws the stick out of the refill package and into the applicator.

3 Claims, 6 Drawing Sheets

METHOD FOR PRODUCING DEODORANT/ANTIPERSPIRANT STILL REFILL

This application is a continuation-in-part of application Ser. No. 08/086,679, filed Jul. 1, 1993, now abandoned.

BACKGROUND OF THE INVENTION

The present invention relates to the manufacturing, packaging and refilling procedure for a solid stick product. i.e. A deodorant/antiperspirant, glue stick, stain remover, insect repellant, muscle pain reliever and lip balms. All of these solid stick type products are packaged in dispenser type packages known as swivel or elevator/threaded shaft dispensers (herein after referred to as applicators). These applicators are constructed mostly of plastic, are well built, disposable and most are not recyclable. Due to the fact of decreasing landfill space and congested solid waste systems, a demand exists to reuse these applicators and supply refill product with less packaging that is recyclable and if landfilled is crushable.

Present inventions regarding refill type stick form products such as Dornbush U.S. Pat. No. 5,255990 utilize elevator mechanisms which reload the product quickly, but the elevating mechanis displaces up to two thirds the space in the applicator that might otherwise be used for product. Patent P.C.T./U593/O836 Fattori, demonstrates a very small amount of product that is completely exposed and is attachable to a retaining handle. The packaging used for this small amount of product seems counter productive in reducing packaging waste. Another example of a refill dispenser is disclosed in U.S. Pat. No. 4884912 issued to Jean-Luis H. Gaeret. December, 1989. Gaeret discloses a lipstick type applicator also having a replaceable product cartridge. This applicator is not an elevator threaded shaft type dispenser. But the elevating mechanism displaces up to two thirds of the applicators volume. U.S. Pat. No. 3429643 issued to D. A. Seaver, Feb. 25, 1967 discloses another lipstick refill, only this package includes the elevating mechanisms for propulsion of the refill product. This invention does reuse the body but the internal mechanisms are discarded. Therefore it is an object of the present invention to provide a refill stick for replenishing product in empty and otherwise disposable dispensers, thus reducing solid waste. It is another object of the invention to provide a package for a stick refill which is recyclable and uses less material than that of a factory filled disposable type dispenser. Still another object of the invention is to provide a refill stick, packaged in a container, providing the maximum amount of product, and utilizing the least amount of material for the package. Another object of the invention is to provide a refill stick in a package which attaches to the dispenser whereby eliminating the need to handle the stick itself, which reduces the chances of damage to the stick, and soiling of the hands. The aforementioned and other objects of the invention will become more apparent in the following descriptions.

SUMMARY

A method of manufacturing a solid stick form product such as a deodorant/antiperspirant and used to refill existing dispensers where the stick product has been exhausted or used up. The solid stick form product is formed and extruded from a mold comprising a one piece body member, formed of elongated tubular sidewalls, an open top end, and a bottom wall section. The cavity formed by the walls is generally oval or cylindrical in configuration. A threaded shaft is axially oriented therein and is rotably mounted to the bottom wall section, through a central opening provided therein. Located on the exterior side of the bottom wall section is a hex head extension of the mold screw. This hex head is fitted to mechanical means which rotates the shaft in either direction. To form the stick product, an elevator platform is threadably mounted to the base of the threaded shaft by rotation of the threaded shaft in a first direction. The chemical product is then poured into the cavity of the mold in its liquid or molten state. upon cooling the product solidifies and takes on the shape of the cavity of the mold. Rotation of the threaded shaft in a second direction opposite to the first, advances the platform and its attached stick out of the mold and into a thin walled, recyclable refill package. The body of the package is in the shape of the stick, one end is closed and has a sealed vent aperture. The other end is open, broadened and has means of applying a cover. To refill an empty dispenser the elevator platform of the exhausted or used up stick is removed and discarded by rotation of the hand wheel on the dispenser. The cover is removed from the refill package and the open recessed end of the dispenser is inserted into the broadened open end of the refill package in a close fitting engagement. The seal is then removed from the vent aperture located at the top of the refill package, thus relieving back pressure on the stick. Rotation of the hand wheel located on the dispenser rotates the dispensers threaded shaft which threadably engages with the refill stick attached platform and draws the refill stick out of the refill package and into the dispenser. When the refill stick is completely withdrawn from its package and secured in the dispenser, the coupled refill package and dispenser are pulled apart and the refill package is discarded to be recycled. The cover of the dispenser is placed back on the dispenser, and an otherwise disposable dispenser is refilled and reused

DESCRIPTION OF THE PREFERRED EMBODIMENTS

Figure 1:
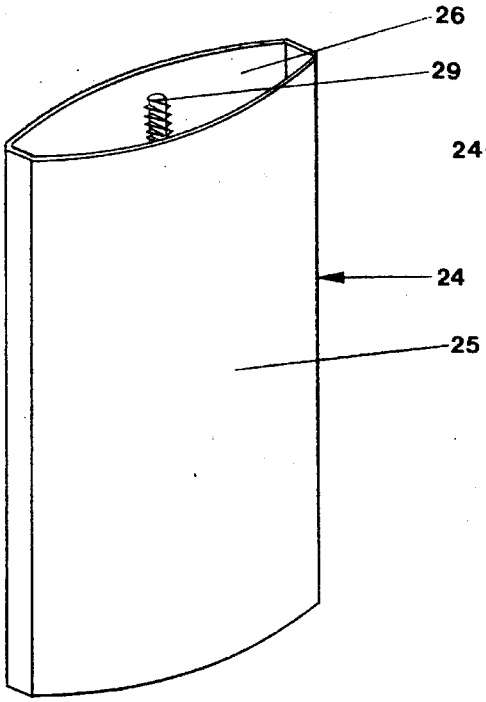
FIG. 1 is a perspective view of one form of a single mold used to form and extrude a stick form product.
Figure 3:
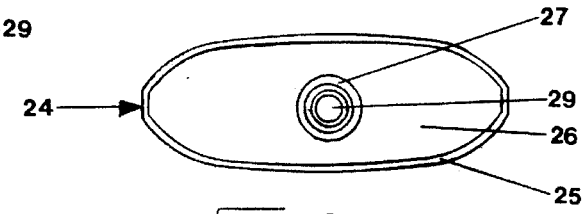
FIG. 3 is a top view of the open end of the mold.
Figure 4:
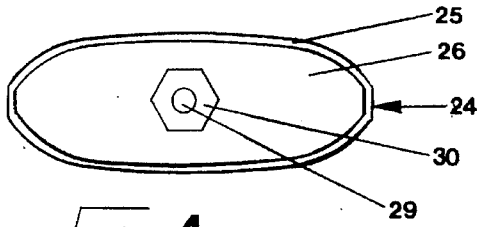
FIG. 4 is a bottom view of the mold.
Figure 2:
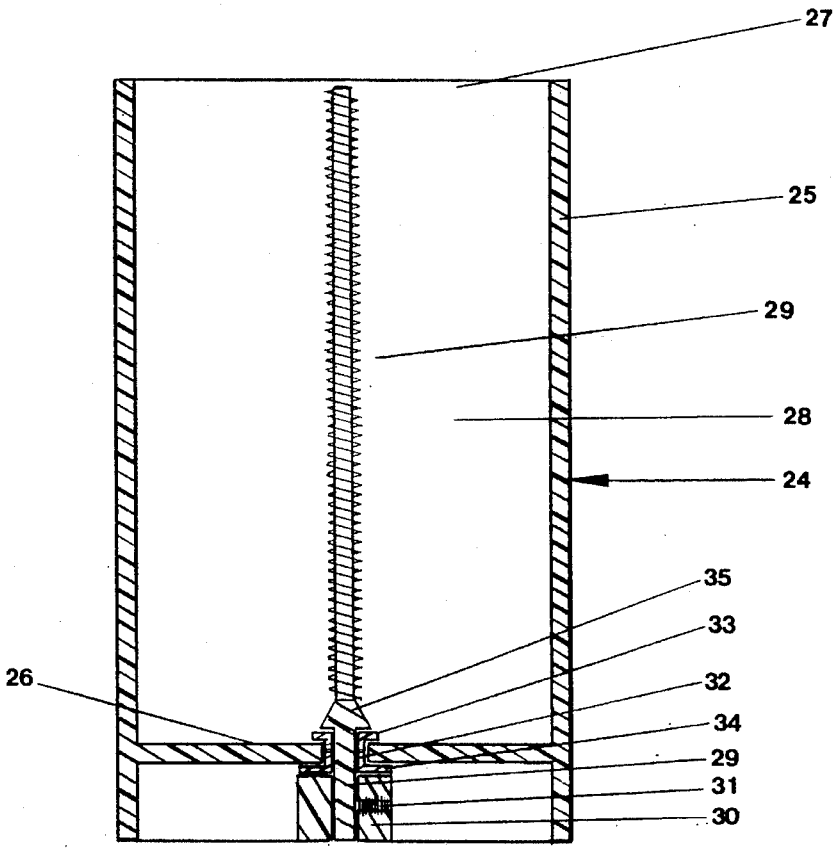
FIG. 2 is a longitudinal cross section of the mold.
Figure 5:
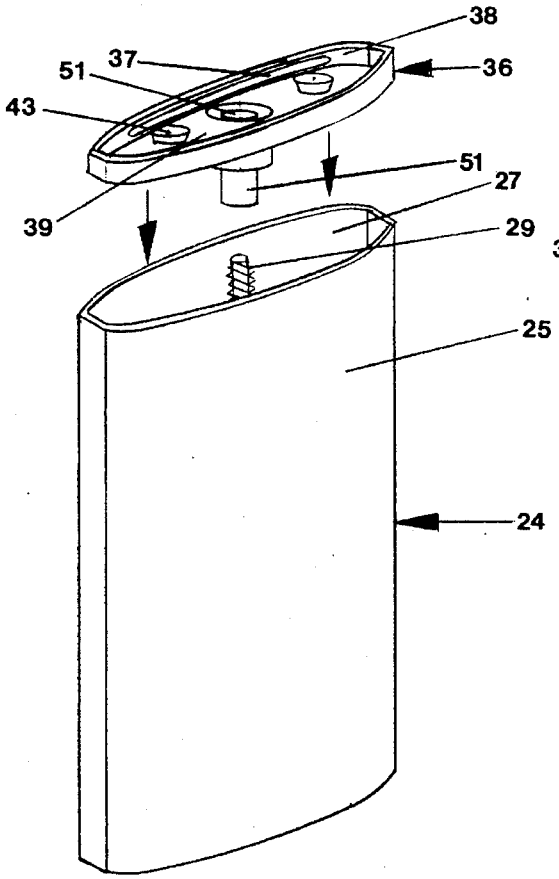
FIG. 5 is a perspective view of the mold with a commonly used type of platform about to be placed into the mold.
Figure 6:
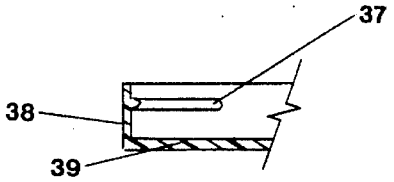
FIG. 6 is a partial cross section of a platform.
Figure 7:
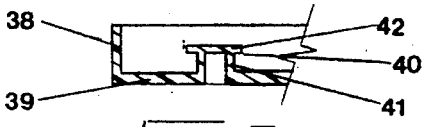
FIG. 7 is a partial cross section of a platform.
Figure 8:
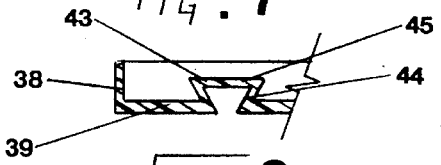
FIG. 8 is a partial cross section of a platform.
Figure 9:
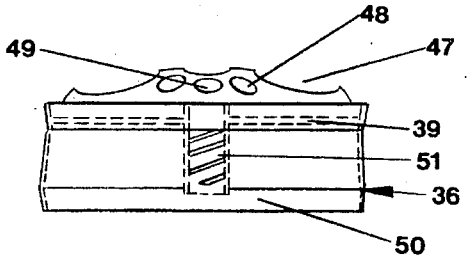
FIG. 9 is a side view of another commonly used platform.
Figure 10:
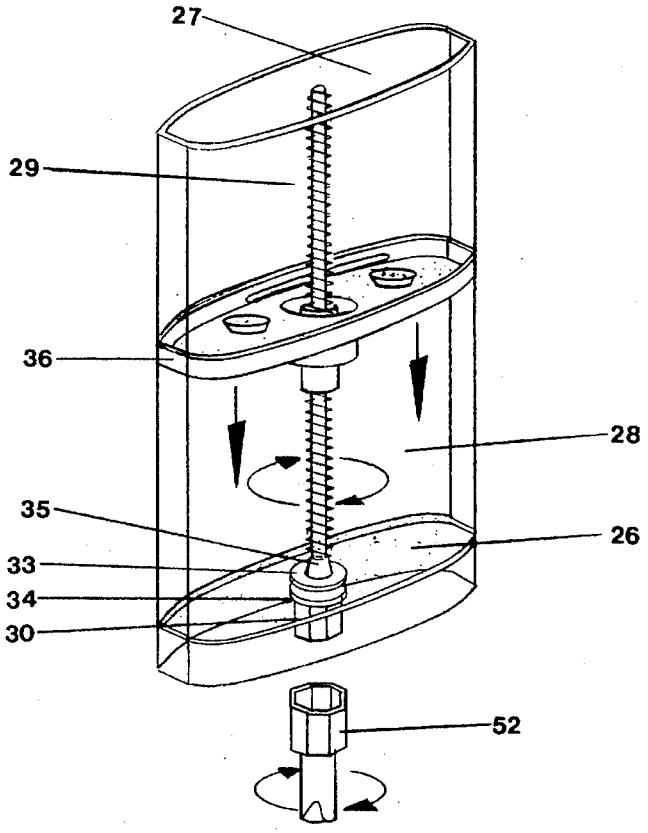
FIG. 10 is a perspective view of the mold during the process of rotation and drawing in of the platform to the base of the mold. This figure is drawn as if constructed of a transparent material.
Figure 11:
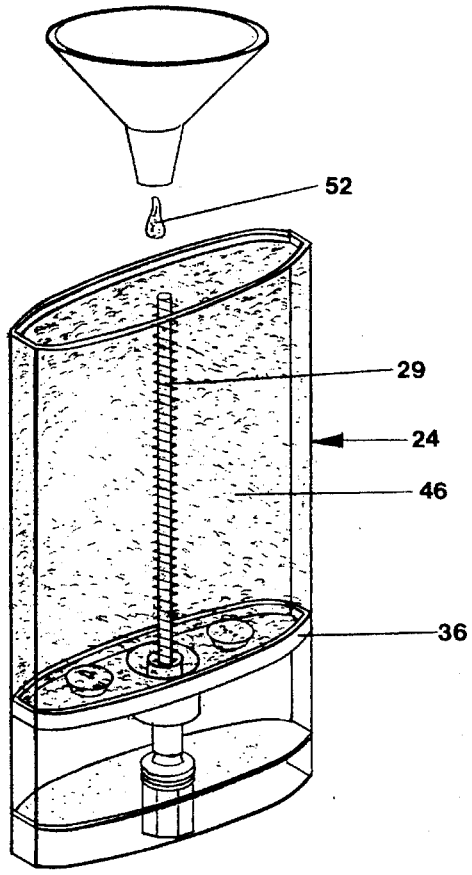
FIG. 11 is a perspective view of the mold with its elevator platform located at its lowest position and the mold is filled with liquid or molten chemical. This figure is drawn as if constructed of a transparent material.
Figure 13:
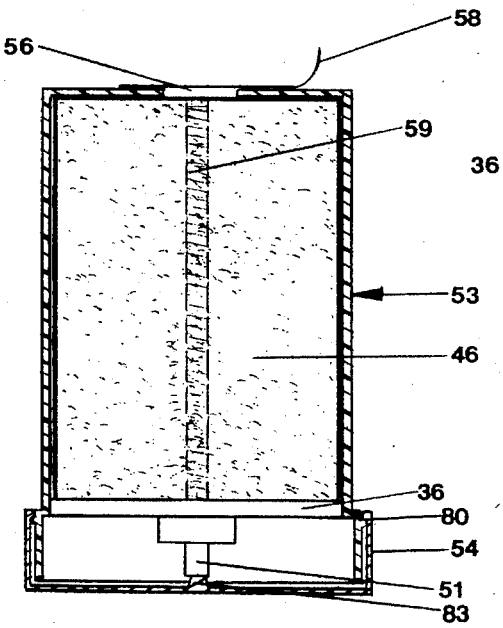
FIG. 13 is a longitudinal cross section of a packaged refill stick product.
Figure 12:
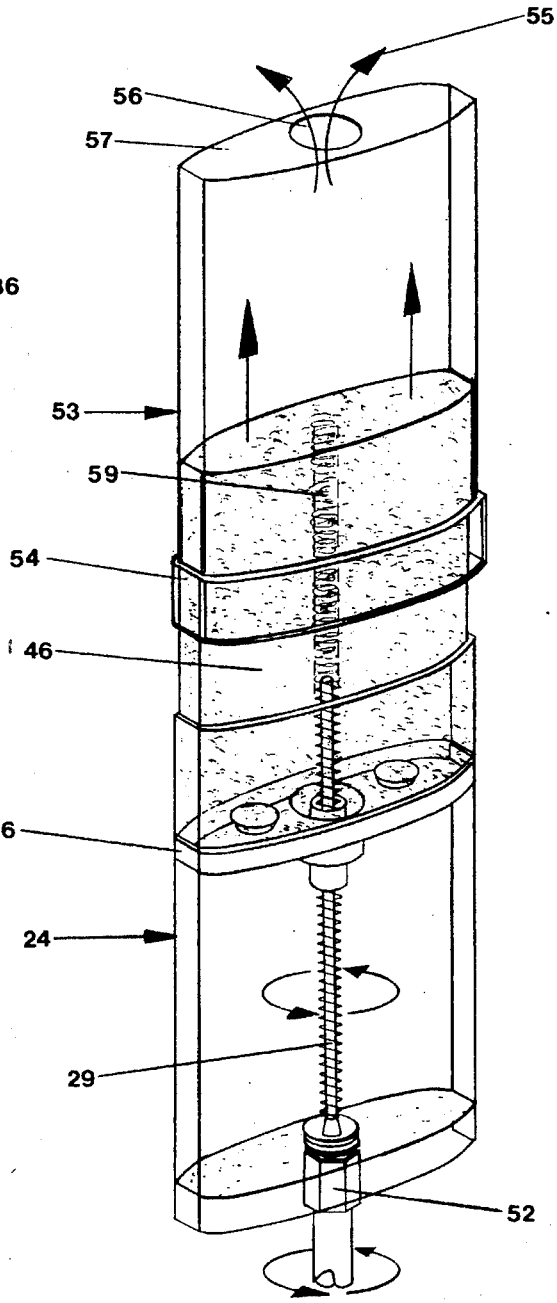
FIG. 12 is a perspective view of the now solid stick being expelled form the mold into the refill package. This figure is drawn as if constructed of a transparent material.
Figure 14:
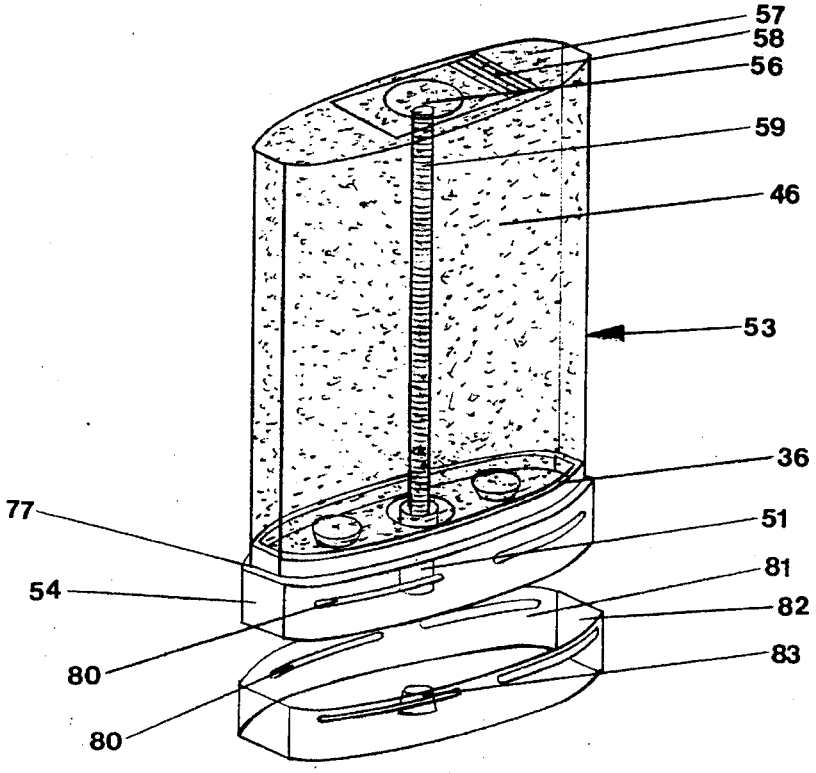
FIG. 14 is a perspective view of a packaged refill stick product.
Figure 15:
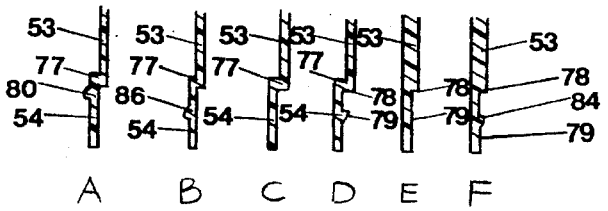
FIG. 15 A, B, C, D, E & F are cross sections of the broadened side wall of the refill package.
Figure 18:
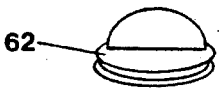
FIG. 18 is a perspective view of a snap on type cover to the vent aperture.
Figure 20:
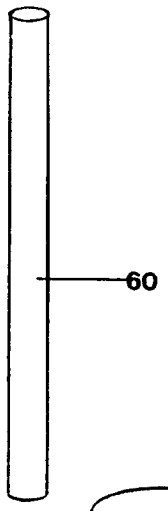
FIG. 20 is a perspective view of a tube.
Figure 16:
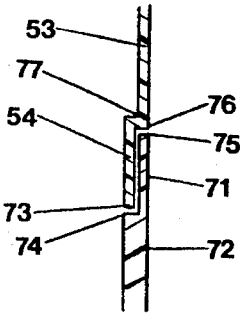
FIG. 16 is a cross section of the broadened side wall coupled to the inwardly stepped section of a dispenser.
Figure 17:
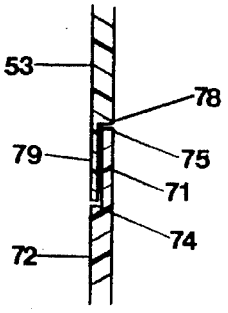
FIG. 17 is an alternative embodiment to FIG. 16.
Figure 19:
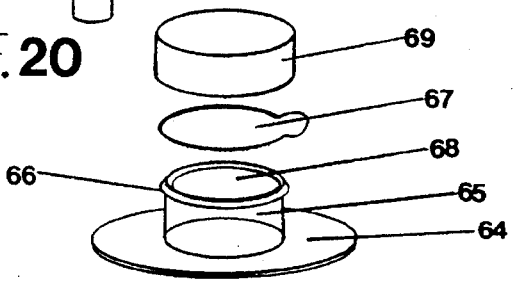
FIG. 19 is a perspective view of an alternate embodiment of a plunger located at the vent aperture.
Figure 21:
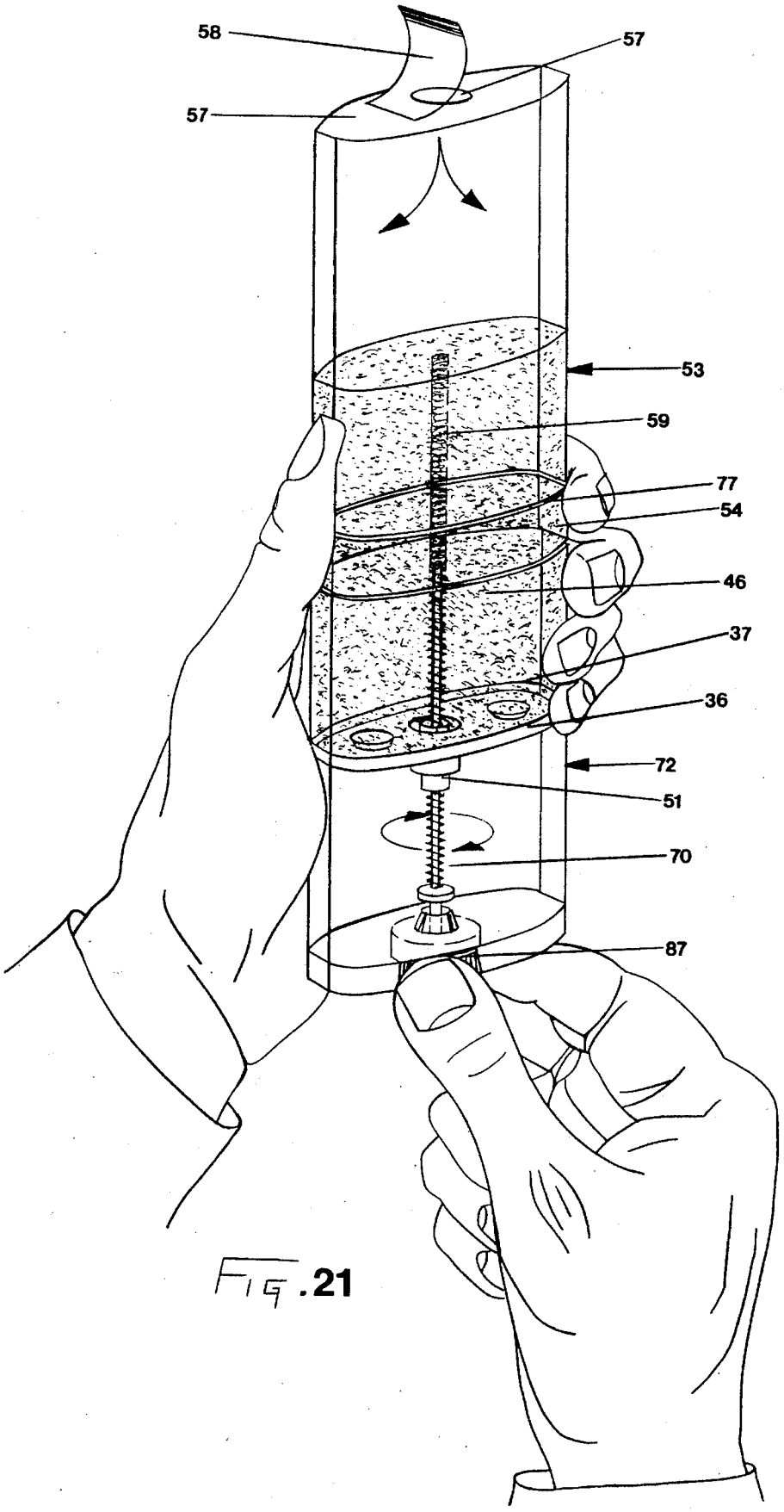
FIG. 21 is a perspective view of a coupled refill package and dispenser and the refill stick being drawn into the dispenser.
Figure 22:
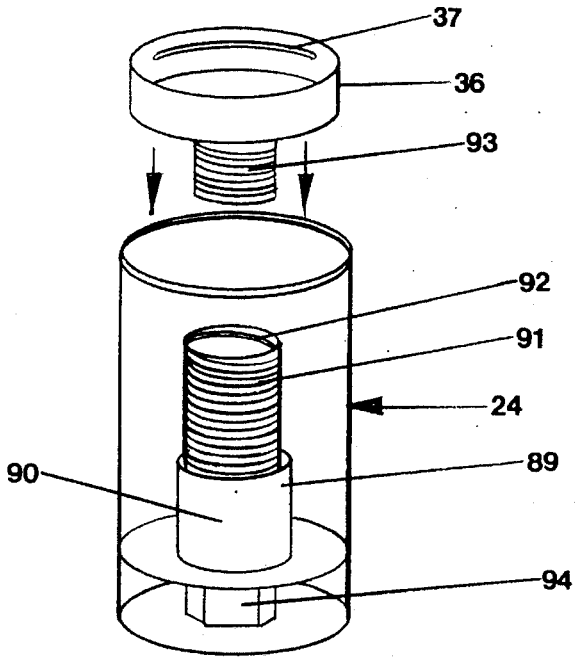
FIG. 22 is an alternative embodiment of the mold showing a telescoping mold screw.
Figure 23:
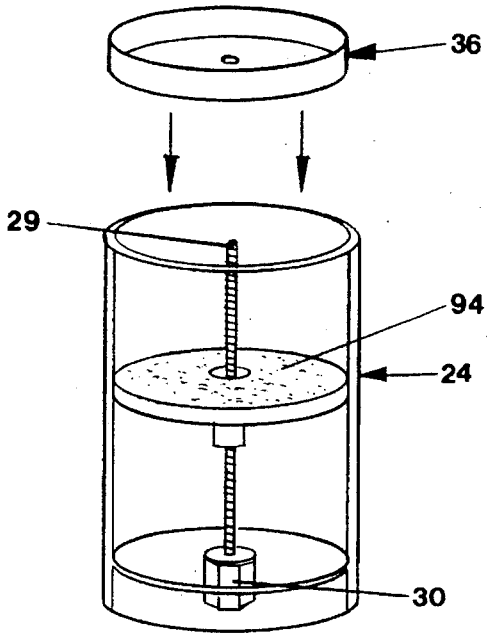
FIG. 23 is a perspective view of an alternative embodiment of the mold whereas the platform serves as a plunger and is a permanent mechanism of the mold.

Referring to the drawings and in particular to FIGS. 1, 2, 3, 4, and 5 there is shown one embodiment of a mold 24 used for forming a solid stick product such as a deodorant/antiperspirant in stick from. The mold 24 generally comprises of a one piece body member formed of elongated tubular side walls 25 a bottom wall section 26 an open top 27 of which surrounds a cavity 28 of which is substantially oval in cross section. A threaded shaft or mold screw 29 extending form a hex head or mold screw head 30 and fastened to the mold screw head 30 by a pin or set screw 31, and passing through the opening 32 centrally located in bottom wall section 26 into the interior or cavity 28 of the mold 24. Mold screw 29 is rotably mounted. A set of bushings 33 and 34 are located about the opening 32 as a means of reducing friction and wear. Directly above bushing 33 is a cone shaped stop which holds the mold screw in place. Stop 35 also functions as a stop for the platform 36. Mold 24 can be manufactured from glass or plastic but the preferred material is metal and more particularly aluminum or stainless steel. The threaded shaft 29 should be manufactured from stainless steel or other non corrosive metal. The inner lining of the cavity may have a non-stick coating such as Teflon or the like to enable the stick product a smoother ejection from the mold. The mold maybe singular as shown or maybe in a block fashion comprising of multi-cavities (not shown). Referring to FIG. 5 there is shown one type of platform 36 is shown to be introduced to mold 24. Platform 36 is a common type of platform used in the industry. Within the confines of the platform are retaining members which anchor the stick to the platform. FIG. 6 shown one type of retaining bead 37 which projects from the wall 38 which arises from the floor of the platform 39 of which is a seal which prevents the liquid or molten state of product from leaking into the lower confines of the cavity 28 located under the platform 36. Referring to FIG. 7 there is shown another type of retaining projection or t-shaped retaining boss 40. Retaining boss 40 has a cylindrical wall 41 arising perpendicularly to the floor of the platform 36. The roof 42 of the retainer 40 extends or over hangs passed the cylindrical wall 41 forming a ledge or anchor of which the molten liquid fills in and around and upon solidifying, holds the stick to the platform which is necessary when the stick and its attached platform are pulled out of the refill package and into the dispenser. FIG. 8 shows yet another type of retaining boss 43 and has the walls 44 projecting diagonally from the floor 39 and together with the roof 35 form a flannel like retainer. These retaining projections and bosses maybe used separately or combined to anchor the platform 36 to the stick form 46. Referring to FIG. 9 there is shown another example of a commonly used elevator platform. This type of platform utilizes a plurality of bosses both concave and convex in shape 47, 48, and 49 in order to anchor the stick 46 to the platform 36. The side walls 50 are extended for sealing means and shown in dotted lines of the floor 39 of the platform 36 and the internally threaded support shaft 51. Referring to FIGS. 5 and 10 there is shown mold 24. A mechanical means of rotation 52 is fitted to the mold screw head 30 and rotation is begun in a first direction. (The author wishes to acknowledge that numerous types of mechanical fittings are possible, as one who is skilled in the prior art would very well know). Platform 36 is introduced through the open top 27 whereas the end or tip of the mold screw 29 is inserted into the boar of the internally threaded support shaft 51. The two sets of threads engage and rotation of the mold screw 29 is continued until the platform 36 is in its lower most position at which such time the rotation of the shaft is stopped. A clutch means mechanism is recommended to be used with the mechanical means of rotation and would serve to protect the internal threads located in the boar of the platforms support shaft 51 from stripping out. Referring now to FIG. 11 with the platform 36 now in its lower most position a predetermined amount of liquid or molten product 52 is poured into the mold cavity. Many types of chemical product such as deodorants/antiperspirants use heated or molted liquids which are then cooled to form a solid stick. However, some stick form products use a catalyst to harden or solidify the liquid into stick form, in either case the liquid is allowed or helped to cool and or solidly. Upon solidification of the stick product 46 the mold 24 is inverted and a mechanical means 52 is fitted to the mold screw head 30. At the same time the refill stick package 53 open broadened end 54 is aligned with the open end 27 of the mold 24. Rotation of the mold screw 29 in a second direction, opposite the first direction, is begun and the platform 36 and its now attached stick 46 are expelled or extruded out of the mold 24 and into the refill package 54. While the stick 46 is being inserted into the refill package 53 air 55 is being displaced by the stick 46 where by a vent aperture 56 is provided at the closed end or roof 57 of the refill package and provides a means of escape for air 55. Referring to FIGS. 13 and 14 there is shown a complete refill package 53 after the stick 46 is placed in the package 53. A means of sealing 58 is applied over the vent aperture 56. The seal 58 is peelable and maybe induction applied or maybe of a self adhesive type. It is recommended that an extension or finger grip be provided to facilitate removal. Located in the center of the stick 46 is a void 59 left by the mold screw 29 as the stick was being extruded from the mold 24. This void is necessary in order to facilitate passage of the threaded shaft located on the dispenser to be refilled. FIG. 20 shows an accessory item which is a hollow tube like structure 60. Tube 60 is inserted into the void 59 either through the threaded boar of the platforms support shaft 51 or through the vent aperture 56. Tube 60 is used to provide support to the side walls of the void should intensive heat be encountered in arid climates or in shipping. Referring to FIG. 19 there is shown an accessory embodiment in the form of a plunger 63. Plunger 63 consists of a base 64 which covers the top surface of the stick in the package. Upstanding tubular side walls arise from the base and a flauge or stop 66 is located about the upper rim. An induction applied peelable seal 67 of which seals the opening 68 and a cover 69 which maybe fitted by friction fit, threaded, or snap on fit and provides protection of the seal 62. Seal 62 maybe of a foil or plastic film. The plunger 63 and cover 69 therefore is preferably manufactured from a common recyclable plastic or metal. Plunger 63 is inserted into refill package 53 before stick 46 is inserted into package 53. The plunger can be used where the stick 46 and its attached platform 36 need to be pushed down in order to make connection with the platform 36 and the dispensers threaded shaft 70. Referring to FIG. 18 there is shown an alternate snap on cap 62 which is filled in the rim of the vent aperture 56. Referring back to FIGS. 14, 16 and 17 there is shown the package 53 for the refill stick 46. The broadened opened end 54 is designed to fit in close fitting engagement over the open inwardly stepped wall section 71 where the cover is fitted on the dispenser 72 being refilled. Referring to FIG. 16 there is shown a cross section of the broadened open end 54 of refill package 53 in close filling engagement with the inwardly stopped section 71 open end of the dispenser 72 to be refilled. Referring now to FIG. 17 there is shown an alternate embodiment of the method of coupling the refill container 53 to the dispenser to be refilled 72. Whereas some stick form products may require a thicker walled 53 refill package and internally stepped recess maybe provided at the open end of the refill package 53. This internally stepped section 75 couples with the inwardly recessed sides of the open end of the dispenser 72 to be refilled. Referring to FIG. 14 there is shown raised beads 80 about the exterior sides of the broadened open end 54. These raised beads 80 allow the raised beads 82 on the inside surface of the walls 81 of the cover 82 to slide over in a snap on like fit. Other snap on type fittings are also possible with this cover. Located in the center of the inside face of the roof of the cover is a raised protuberance 8. Protuberance 83 is domed shaped or cone shaped as shown on FIG. 13 and fits into the rim of the platforms support shaft 51. Protuberance 83 provides as a brace or lateral support to the platform 36 during shipping. Referring to FIG. 15 A–D there is shown cross sections of the broadened end 54 with a raised annular bead FIG. 15 B is a cross section of broadened end 54 and shows a thread 86 with which to twist on a cover. FIG. 15 C is a cross section of broadened end 54 to be used in a friction fit attachment. FIG. 15 D is a cross section of broadened end 54 and shows a raised bead on the inside wall of which to form a snap on fit to the dispenser being refilled. FIG. 15 E shows a friction fit coupling type attachment and FIG. 15 F shows a Snap on type bead 84. The refill package can be manufactured of glass, plastic, metal or a paper product. Plastic is the preferred material and more particularly a common recyclable plastic such as P.E.T.E., H.D.P.E., or L.D.P.E. Referring to FIG. 21 there is shown the refill package 53 coupled to the dispenser 72. Removal of the seal on 58 over the vent aperture 56 releases back pressure on the stick 46 and allows air 55 to enter into the cavity of the refill package 53. It is recommended that the dispensers threaded shaft 70 be extended approximately ¼" so that the tip of the threaded shaft 70 can be inserted into the boar of the platforms support shaft 51 upon coupling of the two packages. Rotation of the hand wheel 87 located at the base of the dispenser is rotated in a second direction opposite the first that which normally raises the stick form product 46. Rotation of the threaded shaft 70 which threadably engages with the internally support shaft 51 of the platform 36 which is connected to the stick 46 by retaining members 37 which combined draws the platform 36 and its attached stick out of the refill package 53 and into the dispenser 72. After the transfer of the stick is complete the refill package 53 and the dispenser 72 are pulled apart and the dispensers original cover is refitted. The refill package and its cover is then discarded and recycled. Referring to FIG. 22 there is shown an alternate embodiment of mold 24. This embodiment utilizes a telescoping mold screw 89. The lower most cylinder 90 has a single thread which threadably engages with the second cylinder 91 which has a plurality of threads about the outside surface and a single inner thread 92 which threadably engages with the exterior threads 93 located on the support shaft of platform 36. Rotation of the telescoping mold screw By connecting a mechanical means of rotation to the telescoping mold screw head 94 raises and lowers the shaft and the attached platform similar to that of threaded shaft in FIG. 1. This mold is used to form refill stick product used in dispensers utilizing telescoping threaded shafts. Referring to FIG. 23 there is shown another embodiment whereas the platform 94 is a permanent part of the mold. A platform 36 of which may use other elevating means can be inserted into the mold without threadably engaging with the mold screw 29 and placed on the platform 94. The filling procedure and the extraction of the stick form product is similar to that shown in FIG. 1 through 12.

I claim:

1. A method of manufacturing a deodorant/antiperspirant stick for use in refilling an empty deodorant/antiperspirant applicator comprising:

A. providing a mold, including a mold cavity with a bottom wall, an open top, and side walls extending between the bottom wall and the open top, said mold also including a rotatable threaded mold screw extending from said bottom wall into said cavity along an axis substantially parallel to said side walls;

B. placing a platform into said mold cavity through the open top, so that the mold screw passes through a threaded central hole of said platform, rotating the mold screw in a first direction to move the platform down into said mold cavity;

C. introducing heated, liquid deodorant/antiperspirant into said mold cavity through the open top;

D. cooling said deodorant/antiperspirant to form a solid stick, with the platform attached to the bottom of the stick and the mold screw extending through the central hole of the platform and into the stick;

E. placing an open refill package adjacent to the open top of the mold cavity with an opening of the refill package aligned with the open top of the mold cavity;

F. rotating the mold screw in a second direction opposite to the first direction to move the platform and stick out of the mold cavity and into the refill package, and applying a cover to the opening of the refill package.

2. A method set forth in claim 1, whereas a plunger is a permanent mechanism of the mold with the mold screw passing through a threaded central hole of the plunger whereas the platform is placed in the cavity of the mold on the plunger with the mold screw passing through the centrally located hole through the platform and upon cooling of the liquid the mold screw is rotated so as to lift plunger, platform and attached stick out of the cavity and into a refill package whereas said plunger is returned to the base of the cavity by reverse rotation of the mold screw.

3. A method as set forth in claim 1, whereas said rotatable mold screw is of a telescoping type.

* * * * *